US008714790B2

(12) United States Patent
Sparks

(10) Patent No.: US 8,714,790 B2
(45) Date of Patent: May 6, 2014

(54) MOUNT FOR A LINEAR LIGHTING ELEMENT

(71) Applicant: Stephen Sparks, Erie, CO (US)

(72) Inventor: Stephen Sparks, Erie, CO (US)

(73) Assignee: TerraLUX, Inc., Longmont, CO (US)

( * ) Notice: Subject to any disclaimer, the term of this patent is extended or adjusted under 35 U.S.C. 154(b) by 0 days.

(21) Appl. No.: 13/623,311

(22) Filed: Sep. 20, 2012

(65) Prior Publication Data

US 2014/0078759 A1 Mar. 20, 2014

Related U.S. Application Data

(60) Provisional application No. 61/537,659, filed on Sep. 22, 2011.

(51) Int. Cl.
*F21S 8/00* (2006.01)

(52) U.S. Cl.
USPC ..... 362/430; 362/397

(58) Field of Classification Search
USPC ..... 362/430, 396, 427
See application file for complete search history.

(56) References Cited

U.S. PATENT DOCUMENTS

| | | | | |
|---|---|---|---|---|
| 4,564,894 | A | | 1/1986 | Gonzalez |
| 4,727,462 | A | | 2/1988 | Komonko |
| 5,436,815 | A | | 7/1995 | Grooms et al. |
| 5,457,614 | A | | 10/1995 | Duty |
| 5,491,621 | A | * | 2/1996 | Duty ..... 362/397 |
| 5,702,082 | A | * | 12/1997 | Evans et al. ..... 248/230.1 |
| 5,836,679 | A | | 11/1998 | Klamm |
| 6,799,863 | B2 | | 10/2004 | Offiler et al. |
| 6,979,100 | B2 | | 12/2005 | Reiff et al. |
| 7,121,698 | B1 | | 10/2006 | Johnson |
| 7,338,189 | B2 | | 3/2008 | Kovacik et al. |
| 7,367,689 | B2 | | 5/2008 | Huang |
| 7,401,940 | B2 | | 7/2008 | Min |

* cited by examiner

*Primary Examiner* — Anne Hines
(74) *Attorney, Agent, or Firm* — Bingham McCutchen LLP

(57) ABSTRACT

Representative embodiments of systems and methods for mounting a tubular or linear illumination device include a substantially planar mounting platform and one or more rings disposed on the mounting platform for grippably receiving the illumination device and enabling rotation of the illumination device therewithin.

28 Claims, 4 Drawing Sheets

MOUNT FOR A LINEAR LIGHTING ELEMENT

CROSS-REFERENCE TO RELATED APPLICATIONS

This application claims priority to and the benefit of, and incorporates herein by reference in its entirety, U.S. Provisional Patent Application No. 61/537,659, which was filed on Sep. 22, 2011.

FIELD OF THE INVENTION

Embodiments of the present invention relate, in general, to mounts for light sources, in particular mounts that may be reversibly affixed to planar surfaces.

BACKGROUND

Linear illumination devices (i.e., those having one dimension much larger than another perpendicular dimension or having an aspect ratio>>1), e.g., "work lights" are widely utilized for a variety of lighting applications. These lights may incorporate incandescent lights, fluorescent tube lights, or even light-emitting diodes (LEDs). Due to the ubiquitous nature of their use, linear illumination devices typically serve as portable lights, which can be manually attached and removed from various workspaces.

Conventional linear illumination devices have simple mechanical mounts that are easily attached and detached to an area including the desired workspace and allow emitted light to be broadly cast thereover. The mount, for example, depicted in FIG. 1A may be a simple hook 110 integrated with an illumination device 112 (e.g., LED light) to allow the light to be hung over various desired workspaces. The simple hook 110, however, does not enable precise positioning of the light source 112 or aiming of the emitted light toward a specific target area. Additionally, since the hook 110 is permanently mounted to the illumination device 112, the useful lifetime of the hook 110 is determined by the relatively shorter lifetime of the light source. Furthermore, the ends 114, 116 of the illumination device 112 are usually opaque due to engagement with the hook; this results in no illumination being provided by either end of the device 112. Finally, in certain environments, there may be no suitable support provided at the workspace for hanging the hook 110.

Referring to FIG. 1B, another strategy for mounting the illumination devices 112 utilizes a pair of magnetic base members 120 for supporting the light source 122 on a surface 122 that is magnetized. Two arcuate arms 124 extending from the base members 120 are pivoted relative to the base members 120 in order to position the light source 122 at a desired location in a work area. Such arcuate arms 124, however, are bulky and significantly increase the required installation space, thereby limiting the application thereof.

Consequently, there is a need for an improved mounting system that is compact, easily attached and detached from a work site and detachable from the light source, and capable of accommodating a variety of surfaces and positions. In addition, it is desirable for the mounting system to be rotatable in order to enable precise aiming of the emitted light, and to be capable of securely and adjustably accommodating a variety of light sources.

SUMMARY

Embodiments of the present invention relate to systems and methods that mount linear and/or tubular illumination devices to various work areas utilizing a substantially planar mounting platform and a ring retention member disposed on the mounting platform for gripping the illumination devices. The mounting system significantly reduces the space consumed by the mounting system compared with conventional mounting approaches. In addition, the mounting system may be easily detached from the illumination device; this allows replacement of the illumination device upon failure thereof. In some embodiments, the ring member disposed on the mounting platform is rotatable in relation to the mounting platform; the direction of light emitted from the illumination devices is thus easily adjustable for precise aim at a desired location. In one embodiment, the ring member includes a split or gap to accommodate various sizes (e.g., diameters) of light sources. The mounting platform may include a mechanism for adjusting the length thereof to accommodate light sources having various lengths. In addition, the mounting system may include a ball-and-spring mechanism that engages securing features (e.g., grooves) of the illumination devices to secure the support therefor. In some embodiments, the mounting system incorporates an attachment mechanism (e.g., a magnet and/or an adhesive) to facilitate releasable attachment to various work sites.

Accordingly, in one aspect, the invention pertains to a mount for a tubular or linear illumination device. In various embodiments, the mount includes a mounting platform and one or more rings disposed on the mounting platform for grippably receiving the illumination device and enabling rotation of the illumination device therewithin. The mount may include two rings located at opposed ends of the platform. Additionally, the mount may include a biasing member protruding within the ring for securing the illumination device therewithin. The biasing member may engage with one or more grooves in the illumination device. In one embodiment, the biasing member is a ball-and-spring mechanism.

In various embodiment, the ring is rotatable in relation to the mounting platform. For example, the ring may be circular. In one implementation, the ring includes a split therein. An inner surface of the ring may be roughened or textured to increase friction for gripping the illumination device.

In some embodiments, the mounting platform includes an attachment mechanism for attaching the mounting platform to a surface. The attachment mechanism may include or consist of a magnet and/or an adhesive. A surface of the attachment mechanism may be substantially coplanar with a surface of the mounting platform. In various embodiments, the width of the mounting platform is larger than the lateral dimension of the ring. In addition, the mounting platform may have an adjustable length.

In another aspect, the invention relates to a method of mounting a tubular or linear illumination device. In various embodiments, the method includes providing a mounting platform including one or more retention rings thereon, grippably receiving the illumination device within the ring, and rotating the illumination device within the ring and relative to the mounting platform to aim illumination from the illumination device. The ring may have a roughened or textured inner surface.

In some embodiments, the method includes attaching the mounting platform to a surface in a work site. Additionally, the method may include securing the illumination device within the ring using a biasing mechanism. In one embodiment, the method includes adjusting a length of the mounting platform to accommodate a length of the illumination device.

In another embodiment, the method includes adjusting the lateral dimension of the ring to accommodate the illumination device.

As used herein, the term "substantially" means±10°, and in some embodiments, ±5°. Reference throughout this specification to "one example," "an example," "one embodiment," or "an embodiment" means that a particular feature, structure, or characteristic described in connection with the example is included in at least one example of the present technology. Thus, the occurrences of the phrases "in one example," "in an example," "one embodiment," or "an embodiment" in various places throughout this specification are not necessarily all referring to the same example. Furthermore, the particular features, structures, routines, steps, or characteristics may be combined in any suitable manner in one or more examples of the technology. The headings provided herein are for convenience only and are not intended to limit or interpret the scope or meaning of the claimed technology.

BRIEF DESCRIPTION OF THE DRAWINGS

In the drawings, like reference characters generally refer to the same parts throughout the different views. Also, the drawings are not necessarily to scale, with an emphasis instead generally being placed upon illustrating the principles of the invention. In the following description, various embodiments of the present invention are described with reference to the following drawings, in which.

DETAILED DESCRIPTION

Figure 1A:
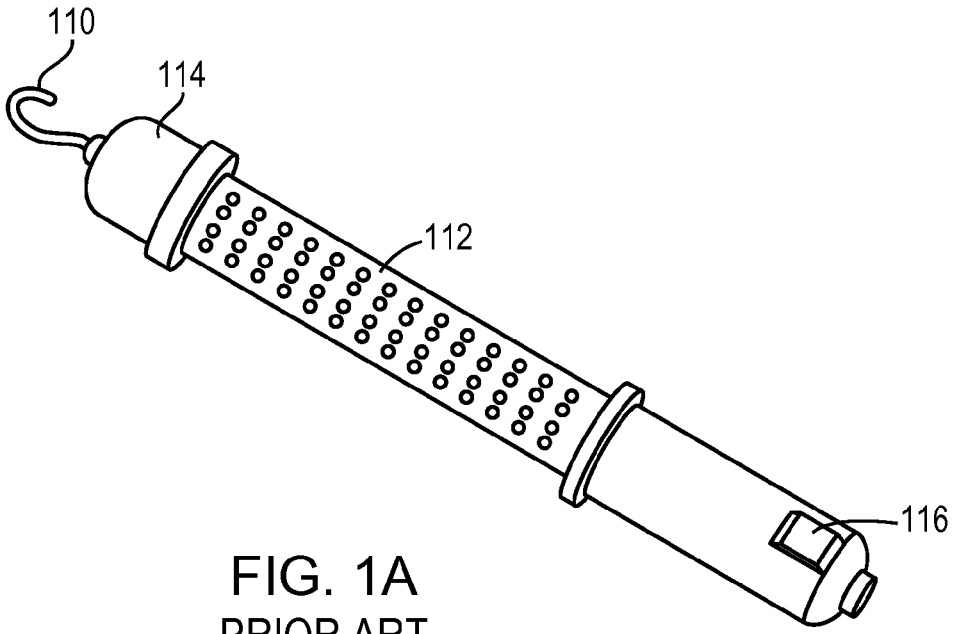
FIG. 1A PRIOR ART
FIGS. 1A and 1B illustrate conventional approaches for mounting an illumination device to a desired workspace in prior-art configurations.
Figure 1B:
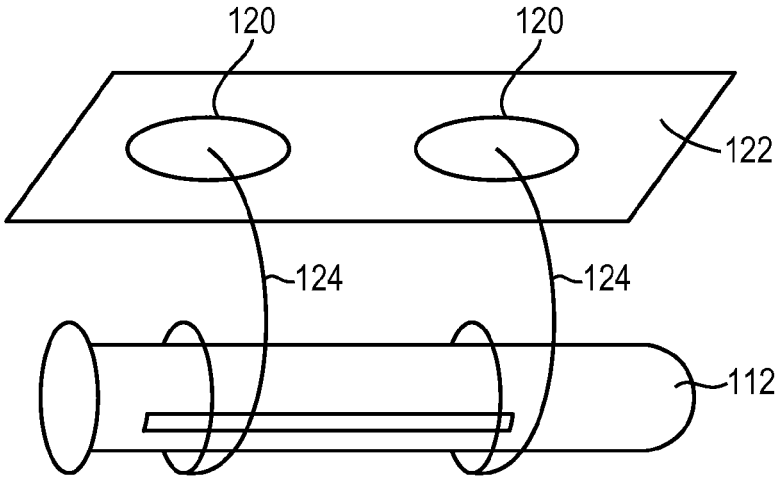
FIG. 1B PRIOR ART
Figure 2:
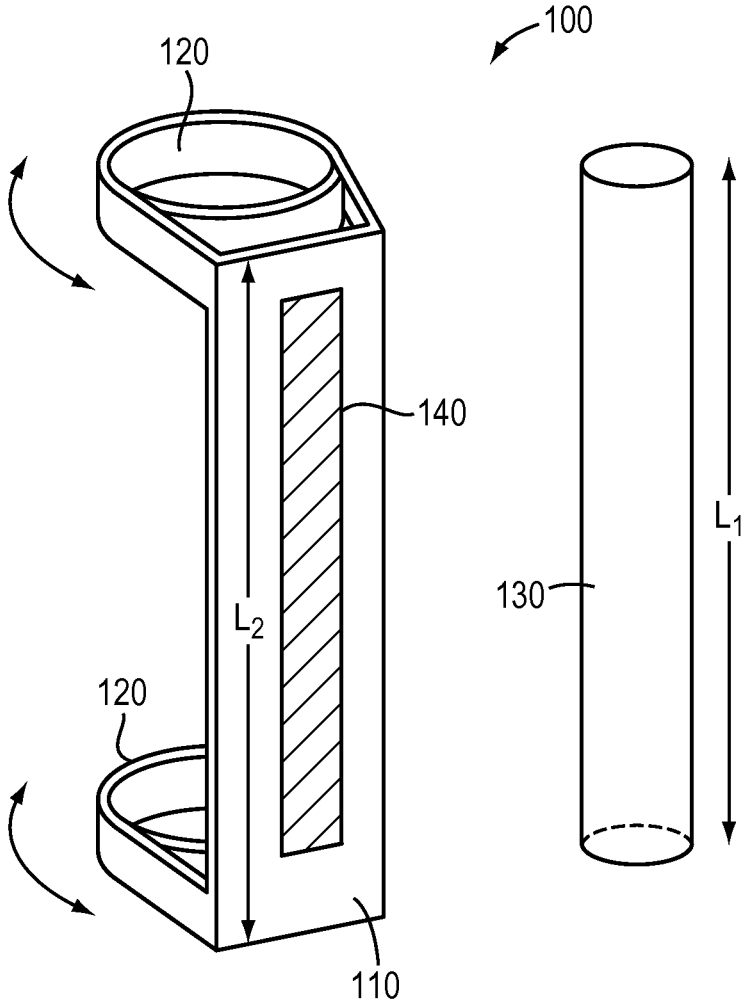
FIG. 2 is a perspective view of a mounting system in accordance with an embodiment of the invention.

Refer first to FIG. 2, which illustrates a mounting system 100 having a substantially planar mounting surface (or mounting platform) 110 and one or more ring retention members 120 for holding a linear and/or tubular illumination device 130; the illustrated embodiment has two retention members 120. The entire mounting system 100 may be mounted to various workspaces via the mounting platform 110. The linear and/or tubular light source 130 is received through the ring members 120 and may then be rotated such that at least a desired portion of the light emitted therefrom is aimed in a desired direction. In various embodiments, the mounting platform 110 incorporates a mounting mechanism 140, such as a magnetic strip and/or a reversible adhesive, for attaching the entire mounting system 100 to any of a variety of different surfaces located at the work area. The magnetic strip and/or adhesive may be recessed such that the surface of mounting platform 110 remains uniformly planar. In one embodiment, the mounting platform 110 is formed from a suitable rigid material (e.g., metal and/or plastic) to increase the rigidity and stability of holding the light sources 130.

Figure 3:
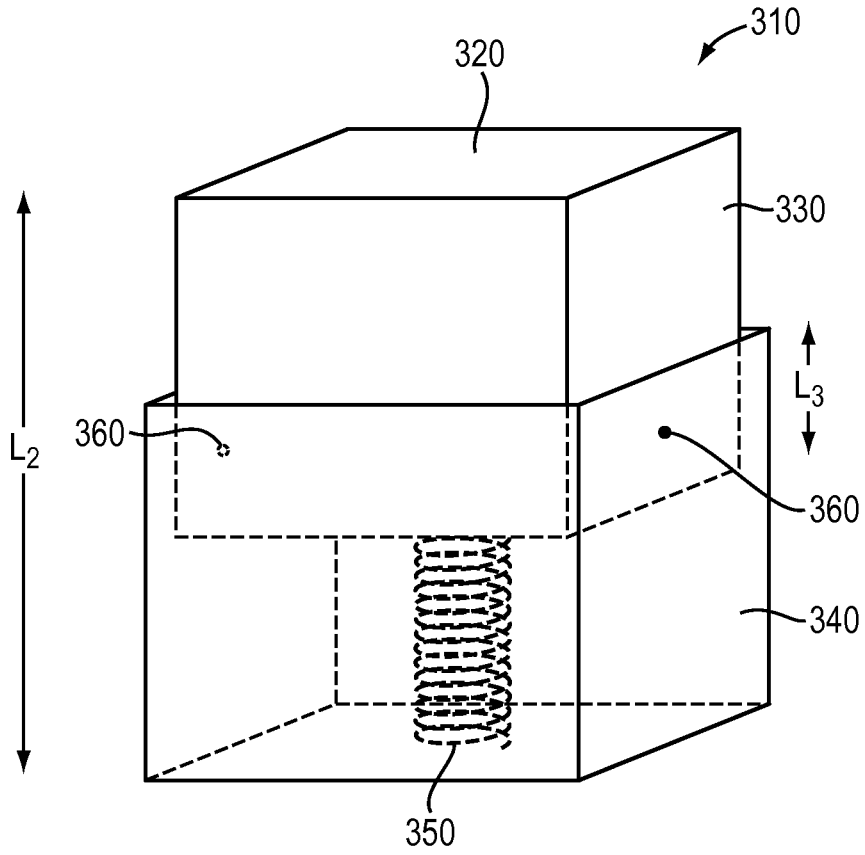
FIG. 3 is a perspective view depicting a mechanism of adjusting a length of a mounting platform in a mounting system in accordance with an embodiment of the invention.

Referring to FIG. 3, in various embodiments, the length $L_1$ of the mounting platform 310 is adjustable to accommodate various lengths of the light sources 130. For example, the platform 310 may be configured as a tubular structure having a rectangular cross-section 320. A first portion 330 of the mounting platform is slidably engaged within a second portion 340 in a telescoping configuration. The entire length $L_1$ of the mounting platform 310 may be adjusted by expanding or contracting the internal length $L_3$ of the first portion 330 that is sleeved within the second portion 340. When a desired length is reached, the relative position of the first portion 330 within the second portion 340 may be fixed using, for example, a compression spring 350 and/or a releasable latch 360. In one embodiment, the entire length $L_1$ of the mounting platform 110 is equal to or shorter than the length $L_2$ of the light source 130 such that the light source 130 are securely retained by the mounting system 100. Additionally, because the ends of the light source 130 remain uncovered when secured within the mounting system 100, illumination from either end thereof may be provided.

Figures 4A, 4B:
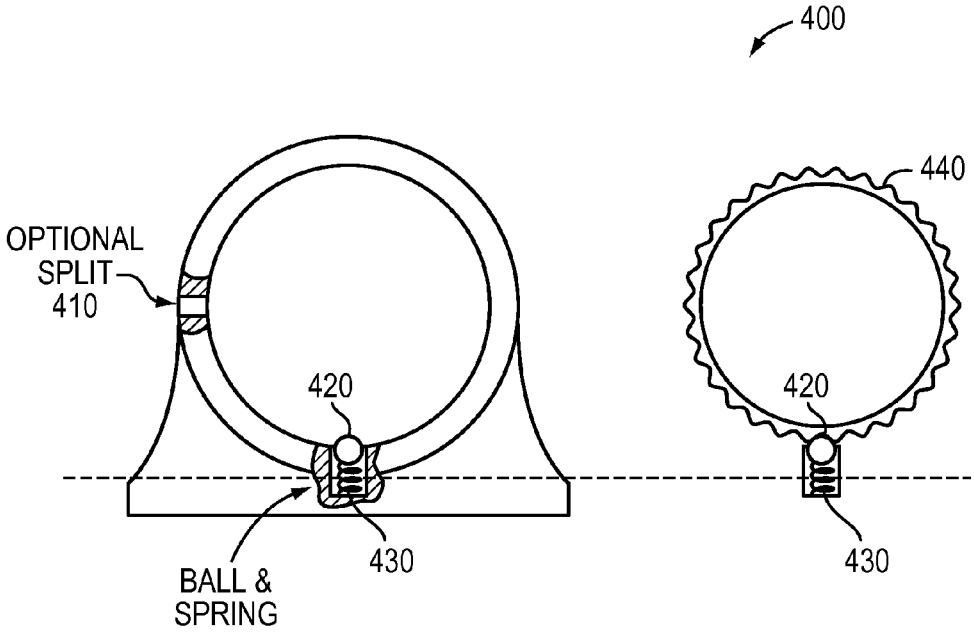
FIGS. 4A and 4B are elevations depicting rings of a mounting system incorporating features for gripping the illumination sources in accordance with an embodiment of the invention.

Referring to FIGS. 4A and 4B, the mounting system 100 may include one or more curved members (e.g., substantially circular or elliptical rings 400, two of which are shown in FIG. 4) to grip the linear or tubular illumination device 130. In one embodiment, the ring(s) 400 are attached to the planar mounting platform 110 reversibly or irreversibly. If, for example, the ring 400 and the planar mounting platform 110 are reversibly attachable, a broken component may be easily replaced without discarding the entire mounting system 100. In another embodiment, the rings 400 and the mounting platform 110 are a solid integral unit formed by, e.g., injection molding or soldering. The rings 400 may be substantially circular to enable rotation of the illumination device 130 therewithin so that the illumination device 130 can be aimed. In one embodiment, the rings themselves rotate relative to the mounting platform 110. For example, the platform 110 may include a pair of raised guides having opposed walls rising from the platform surface and including aligned slots therethrough; the rings pass through the slots, which are spaced apart by a distance that permits the round rings to slide through the linear space they define between them with enough friction to retain the rings but not so much as to prevent their convenient rotation by a user. The rings 400 may be made of substantially rigid or slightly flexible material, such as plastic, metal, and/or another suitable material; in the case of rotatable rings, the rings may be slightly deformable to facilitate their convenient rotation through the slots, and when released, the rings resume their natural curvature that retains them within the linear guides.

The rings 400 may include various features to accommodate variously sized illumination devices 130 securely but without damage thereto. With reference to FIG. 4A, the rings 400 may feature a split or gap 410 to accommodate illumination devices 130 of various sizes (e.g., different widths or diameters). The split or gap 410 widens as necessary to accommodate the illumination device 130 and the ring 400 thereby acts as a spring, retaining the illumination device 130 therewithin. Conversely, the ring 400 may be compressed to wrap firmly around an illumination device 130 that has a width or diameter smaller than the corresponding lateral dimension (e.g., diameter) of the ring 400; in this case the split 410 enables the opposed ring portions to overlap. In some embodiments, split rings are made of materials (e.g., metal) that can both expand (widen) in a biased manner but also retain a compressed configuration without failure. In various embodiments, the width of the mounting platform is larger than the corresponding lateral dimension (e.g., diameter) of the rings in order to provide stability when mounted on uneven and/or slanted surfaces.

The rings 400 may grip the illumination sources 130 predominantly via the friction between the illumination source 130 and the inner surfaces of the rings 140. In one embodiment, the inner surfaces of the rings 140 are roughened or textured in order to increase the static friction. In various embodiments, the rings 400 incorporate another mechanism (preferably adjustable) for gripping the illumination sources 130. Referring to FIG. 4A, the rings 400 may incorporate, for example, a ball, rod or other protruding feature 420 that exerts force against the illumination source 130 via a biasing spring 430; the features 420 are preferably rounded and/or cushioned to avoid damage to the illumination source 130, which is then snugly gripped within the rings 400. Referring to FIG. 4B, in some embodiments, the illumination sources 130 include one or more grooves 440 (e.g., axial grooves) that are complementary to and engaged by the feature 420 to enable a more secure fit within the rings. In other embodiments, however, the illumination source 130 remains rotatable around its axis within the rings 400 so the emitted light may be aimed.

In various embodiments, the mounting system 100 is compatible with any of a variety of linear and/or tubular illumination sources 130, e.g., those of the type described in U.S. Provisional Patent Application Ser. No. 61/385,382, filed on Sep. 22, 2010, the entire disclosure of which is herein incorporated by reference.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A mount for a tubular or linear illumination device, the mount comprising:

a mounting platform;

at least one ring disposed on the mounting platform for grippably receiving the illumination device and enabling rotation of the illumination device therewithin; and a ball-and-spring mechanism protruding within at least one ring for securing the illumination device therewithin.

2. The mount of claim 1, wherein the at least one ring is rotatable in relation to the mounting platform.

3. The mount of claim 1, wherein the at least one ring comprises a split therein.

4. The mount of claim 1, wherein the mounting platform comprises an attachment mechanism for attaching the mounting platform to a surface.

5. The mount of claim 4, wherein the attachment mechanism comprises at least one of a magnet or an adhesive.

6. The mount of claim 4, wherein a surface of the attachment mechanism is substantially coplanar with a surface of the mounting platform.

7. The mount of claim 1, wherein the ball-and-spring mechanism engages with at least one groove in the illumination device.

8. The mount of claim 1, wherein a width of the mounting platform is larger than a lateral dimension of the at least one ring.

9. The mount of claim 1, wherein the at least one ring is circular.

10. The mount of claim 1, wherein an inner surface of the at least one ring is roughened or textured to increase friction for gripping the illumination device.

11. The mount of claim 1, wherein the mounting platform has an adjustable length.

12. The mount of claim 1, wherein the mount comprises two rings located at opposed ends of the platform.

13. A method of mounting a tubular or linear illumination device, the method comprising:

providing a mounting platform comprising at least one retention ring thereon;

adjusting a length of the mounting platform to accommodate a length of the illumination device;

grippably receiving the illumination device within the at least one ring; and rotating the illumination device within the ring and relative to the mounting platform to aim illumination from the illumination device.

14. The method of claim 13, further comprising attaching the mounting platform to a surface in a work site.

15. The method of claim 13, further comprising securing the illumination device within the at least one ring using a biasing mechanism.

16. The method of claim 13, wherein the at least one ring has a roughened or textured inner surface.

17. The method of claim 13, further comprising adjusting a lateral dimension of the at least one ring to accommodate the illumination device.

18. A mount for a tubular or linear illumination device, the mount comprising:

a mounting platform;

at least one ring disposed on the mounting platform for grippably receiving the illumination device and enabling rotation of the illumination device therewithin; and a biasing member protruding within the at least one ring for securing the illumination device therewithin, wherein the biasing member engages with at least one groove in the illumination device.

19. The mount of claim 18, wherein the at least one ring is rotatable in relation to the mounting platform.

20. The mount of claim 18, wherein the at least one ring comprises a split therein.

21. The mount of claim 18, wherein the mounting platform comprises an attachment mechanism for attaching the mounting platform to a surface.

22. The mount of claim 21, wherein the attachment mechanism comprises at least one of a magnet or an adhesive.

23. The mount of claim 21, wherein a surface of the attachment mechanism is substantially coplanar with a surface of the mounting platform.

24. The mount of claim 18, wherein a width of the mounting platform is larger than a lateral dimension of the at least one ring.

25. The mount of claim 18, wherein the at least one ring is circular.

26. The mount of claim 18, wherein an inner surface of the at least one ring is roughened or textured to increase friction for gripping the illumination device.

27. The mount of claim 19, wherein the mounting platform has an adjustable length.

28. The mount of claim 18, wherein the mount comprises two rings located at opposed ends of the platform.

* * * * *